US005331779A

United States Patent [19]

Hing

[11] Patent Number: 5,331,779

[45] Date of Patent: Jul. 26, 1994

[54] TRUSS FRAMING SYSTEM FOR CLUSTER MULTI-LEVEL HOUSING

[76] Inventor: Ally O. Hing, P.O. Box A, Superior, Ariz. 85273

[21] Appl. No.: 965,712

[22] Filed: Oct. 23, 1992

[51] Int. Cl.[5] ..... E04H 1/00

[52] U.S. Cl. ..... 52/80.1; 52/DIG. 10; 52/81.1; 52/81.2; 52/236.2

[58] Field of Search ..... 52/DIG. 10, 81.2, 81.3, 52/81.4, 79.4, 236.1, 236.2, 236.3, 234, 80.1, 79.1

[56] References Cited

U.S. PATENT DOCUMENTS

| | | | |
|---|---|---|---|
| 2,682,235 | 6/1954 | Fuller | 108/1 |
| 2,986,241 | 5/1961 | Fuller | 189/34 |
| 3,063,521 | 11/1962 | Fuller | 189/34 |
| 3,139,957 | 7/1964 | Fuller | 189/1 |
| 3,220,152 | 11/1965 | Sturm | 52/DIG. 10 |
| 3,331,168 | 7/1967 | Frey | 52/79.4 |
| 3,618,273 | 7/1969 | Crandall | 52/79.4 |
| 3,974,600 | 8/1976 | Pearce | 52/81.4 |
| 4,014,110 | 3/1977 | Mayer | 434/277 |
| 4,207,715 | 6/1980 | Kitrick | 52/81 |
| 4,650,424 | 3/1987 | Mitchell | 52/DIG. 10 |
| 4,719,726 | 1/1988 | Bergman | 52/81.4 |
| 4,722,162 | 2/1988 | Wilensky | 52/DIG. 10 |
| 4,723,382 | 2/1988 | Lalvani | 52/DIG. 10 |

FOREIGN PATENT DOCUMENTS

| | | | |
|---|---|---|---|
| 842156 | 6/1981 | U.S.S.R. | 52/DIG. 10 |

*Primary Examiner*—Peter M. Cuomo
*Assistant Examiner*—Darnell M. Boucher
*Attorney, Agent, or Firm*—Warren F. B. Lindsley

[57] ABSTRACT

A multi-level cluster housing array held together by a skeletal framework formed of octahedron-tetrahedron components.

6 Claims, 3 Drawing Sheets

TRUSS FRAMING SYSTEM FOR CLUSTER MULTI-LEVEL HOUSING

BACKGROUND OF THE INVENTION

This invention relates to a framework for enclosing space and more particularly to an octahedron-tetrahedron truss (octet truss}inscribed one within each of a plurality of closely stacked spheres to form multi cluster housing.

The following terms used herein are defined as follows:

Octahedron—A polyhedron having eight equal equilateral triangular plane faces or sides but can be isosceles in form; may be skeletal, as when made of interconnected struts; or continuous, as when made of interlocking or interconnected sheets or plates; or partly skeletal and partly continuous.

Tetrahedron—A polyhedron having four equal equilateral triangular plane faces or sides but can be isosceles in form. Like the octahedron, it may be skeletal, continuous, or a combination of the skeletal and continuous forms.

Octahedron-tetrahedron system—An assemblage of octahedrons and tetrahedrons in face to face relationship. Thus when four tetrahedrons are grouped to define a larger tetrahedron, the resulting central space is an octahedron; together, these figures are comprised in a single, or "common" octahedron-tetrahedron system.

Framework—The frame of a structure for enclosing space, or the frame of a roof, wall or floor; used to distinguish from individual frame components of a roof, wall or floor, so as to denote the whole as distinguished from its parts.

The performance of any building frame is judged by the structural weight needed to shelter a given space. By constructing a frame formed of an octet truss configuration in a sphere, buildings can be erected that greatly reduce the compression components of the configuration over that found in the marketplace. Currently, heavy reinforced concrete compression members are used in multi-level buildings to hold up the structure with little thought being given to the use of tension members.

The disclosed octet truss for use in spheres results in a grid structure that substantially uniformly stresses all of the framework acting almost as a membrane in absorbing and distributing loads. The resulting structure of the disclosed trusses for multi-level cluster housing results in a spidery framework of many lightweight pieces, such as aluminum rods, tubes or extended sections which complement one another in the particular pattern of the finished assembly so as to provide an extremely favorable weight-strength ratio for withstanding high stresses.

DESCRIPTION OF THE PRIOR ART

Although trusses have been used for generally spherical forms, none have been.. used to form spherical cluster multi-level housing.

U.S. Pat. No. 2,682,235 discloses a building framework of a generally spherical form in which the main structural elements are interconnected in a geodesic pattern of approximately great circle arcs intersecting to form a three-way grid defining substantially equilateral triangles.

U.S. Pat. No. 2,986,241 discloses the use of an octahedron-tetrahedron truss for building purposes for use in spherical forms.

U.S. Pat. No. 3,063,521 discloses a system of construction which utilizes the tensile properties of structural materials to provide an assemblage of tension and compression components arranged in a discontinuous compression system.

U.S. Pat. No. 3,139,957 discloses a suspension building comprising a series of box frames of progressively varying sizes arranged in a concentric array at predetermined sequentially different heights above a common plane of reference and in vertically overlapping spaced relation one to another and tension elements between and fixedly secured to adjacent pairs of box frames in the series.

U.S. Pat. No. 4,207,715 discloses a tensegrity module structure and method of interconnecting the modules.

SUMMARY OF THE INVENTION

In accordance with the invention claimed, a new and improved truss framing system is provided for cluster multi-level housing which results in a grid structure that substantially uniformly stresses all of the framework.

It is, therefore, one object of this invention to provide a new and improved truss system for multi-level cluster housing.

Another object of this invention is to provide a new and improved framework for cluster multi-level housing employing interconnected octahedron-tetrahedron grid configurations.

A further object of this invention is to provide a new and improved multi-level cluster housing design.

A still further object of this invention is to provide multi-level housing modules in each sphere of a multi-level spherical assembly.

A still further object of this invention is to provide a vertical array of a plurality of housing modules in a spherical assembly.

Further objects and advantages of this invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which:

FIGS. 1–5 comprise prior art wherein:

FIG. 1 is an exploded arrangement of a multi-level stacking of a plurality of spheres;

FIG. 2 is an illustration of a tetrahedron;

FIG. 3 is an illustration of an octahedron;

FIG. 4 is an illustration of an octahedron-tetrahedron truss;

FIG. 5 is an illustration of a cube stabilized by a tetrahedron;

DESCRIPTION OF THE PREFERRED EMBODIMENT

Figure 1:
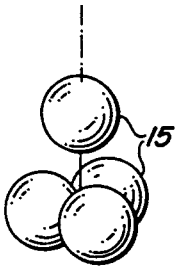
FIG. 1 (PRIOR ART)

Referring more particularly to the drawings by characters of reference, FIGS. 1–5 illustrate prior geometrical configurations with FIG. 1 illustrating an exploded view of a plurality of spheres 15 for arranging in a stack array.

Figure 2:
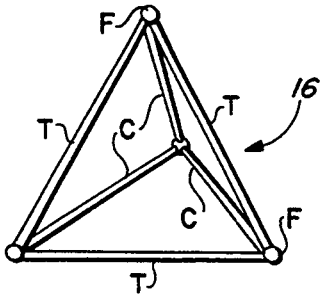
FIG. 2 (PRIOR ART)
Figure 4:
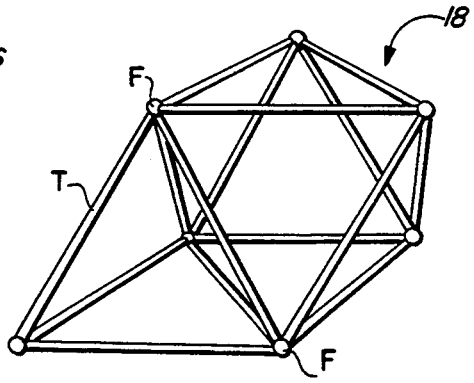
FIG. 4 (PRIOR ART)
Figure 3:
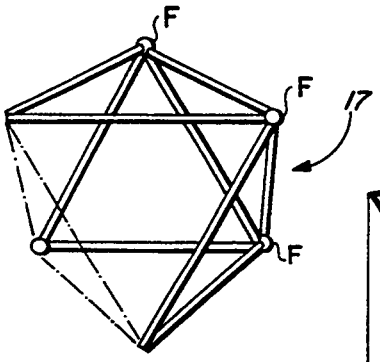
FIG. 3 (PRIOR ART)

FIGS. 2–4 illustrate a tetrahedron 16, octahedron 17 and an equilateral octahedronal-tetrahedronal truss 18 consisting of all members in interconnecting array. In FIG. 2, the compression members are marked C and the tension members marked T.

Figure 5:
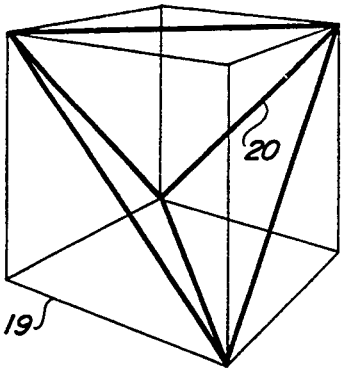
FIG. 5 (PRIOR ART)

FIG. 5 illustrates a cube 19 stabilized by a tetrahedron 20 shown in heavy lines.

Figure 6:
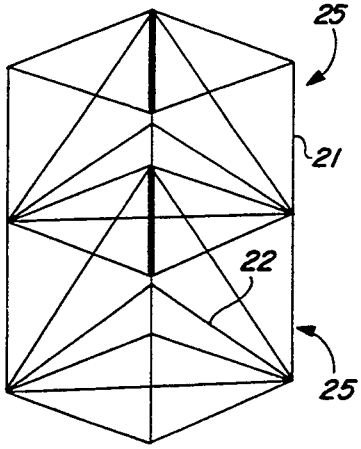
FIG. 6 is an illustration of a prism stabilized by a set of tetrahedron trusses, becoming octahedronal upon connecting with the prism's cubic struts.

FIG. 6 illustrates a prism 21 stabilized by two equilateral-tetrahedronal trusses 22 becoming an isosceles octahedronal-tetrahedronal truss by interconnection with the prism struts.

Figure 7:
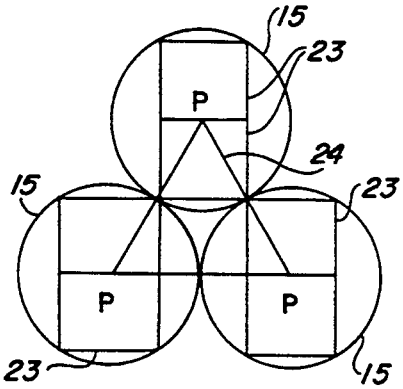
FIG. 7 is a side view of a two level stacking of spheres illustrating multi-level housing modules in each sphere and stabilized by the greater equilateral octahedron-tetrahedron trusses.

FIG. 7 is a side view of a bi-level stacking of a plurality of spheres 15 illustrating the bi-level modules 23 of a housing arrangement supported by the greater equilateral octahedronal-tetrahedronal truss system 24 hereinafter called an octet truss.

As noted, the center of each sphere P is interconnected by a strut 24 which is twice the radius of the common diameter spheres 15. The center P ks also the center of module 21 as shown in FIG. 6.

It should be known that the present invention provides an extremely favorable weight-strength ratio of supporting trusses for rectangular prisms formed within a spherical form known as a geodesic dome. The present invention discloses how to gain an extremely favorable weight-strength ratio in structures of other forms such as rectangular prism created within the dome or sphere.

In the sphere, the tremendous gain in the weight-strength ratio occurs primarily from a unique arrangement of the main structural elements in which they are all aligned with great circles of a common sphere. In this sense, geodesic construction could be considered inapplicable as such to building frameworks of other than spherical form. However, as disclosed herein if struts or sheets of equal length are comprised within a common octahedron-tetrahedron truss system and also in alignment (contact) with the great circles (in this case two circles crossing 90 degrees through the corners of the prism), the strength of the framework is far greater than would be predictable using any conventional formulae based on resolution of forces and known values of the strength of materials.

In general, the invention disclosed utilizes octahedron-tetrahedron trusses arranged within spheres and interconnected in a pattern to yield a new optimum of tensile compressive integrity throughout the framework. The disclosed truss system yields in each application surprising results in terms of the fundamental weight-strength ratio.

The octahedron 17 and a conjoined tetrahedron 16 may be imagined as being formed of a number of struts of equal length joined together at their ends in any suitable manner as by fitting F. Tetrahedron 16 has six struts and four equal equilateral triangular plane faces or sides. Octahedron 17 has twelve struts and eight equilateral triangular plane faces or sides. In FIG. 3 three of the struts have been shown by dot-dash lines because when tetrahedron 16 and octahedron 17 of FIGS. 2 and 3 are conjoined as shown in FIG. 4, these struts are con, non to tetrahedron 16 and octahedron 17.

As the truss is assembled so as to extend or grow in other directions, con, non struts and con, non faces or sides between all of the conjoined octus and tetras occur in the completed framework. If one adheres to the integrity of this octetruss system., the structure will comprise a stable deci-octahedron (an eighteen-sided polyhedron). Still further, the major axes of all octahedrons will be in parallelism throughout the framework, whereby all of the structural elements will be comprised in a single octahedron-tetrahedron system of optimum tensile-compression integrity throughout. Further, the sides of the octas and tetras will lie in con%mon planes forming plane surfaces of the truss. The arrangement can additionally be defined as a roof, wall and floor framework consisting of a truss in which the main structural elements form triangles interconnecting in a pattern defining five great circles (planes) intersecting one another two times at 90 degree angles, all such planes conforming to a common system of polyhedrons.

Each unique plane is considered as including planes parallel to it and symmetrically oriented with respect to one another. The polyhedrons (octahedrons and tetrahedrons) may be skeletal, as when made of interconnected struts, as shown in FIGS. 5 and 6 or continuous, as when made of interlocking or interconnected sheets or plates, or partly skeletal and partly continuous, as when made partly of interlocking sheets and partly of struts.

Figure 8:
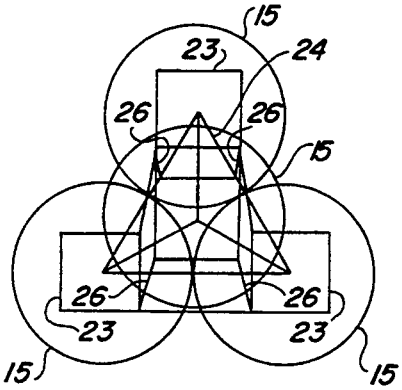
FIG. 8 is a top view of FIG. 7.

As shown in FIG. 6, a rectangular prism 21 comprising a pair of stacked cubes 25 may form a stabilized skeletal framework fitting into a sphere 15 as shown in FIGS. 7 and 8.

Further, an octet truss may be used to interlock a plurality of stacked spheres 15, as shown in FIGS. 7 and 8, in a stabilized framework.

Thus, a stacked array of spheres may employ an octet truss system to not only define a bi-level arrangement of cubical prisms or rectangular prisms in each of a plurality of stacked spheres but also use an octet skeletal truss to hold together a plurality of stacked spheres as shown in FIGS. 7 and 8.

Figure 13:
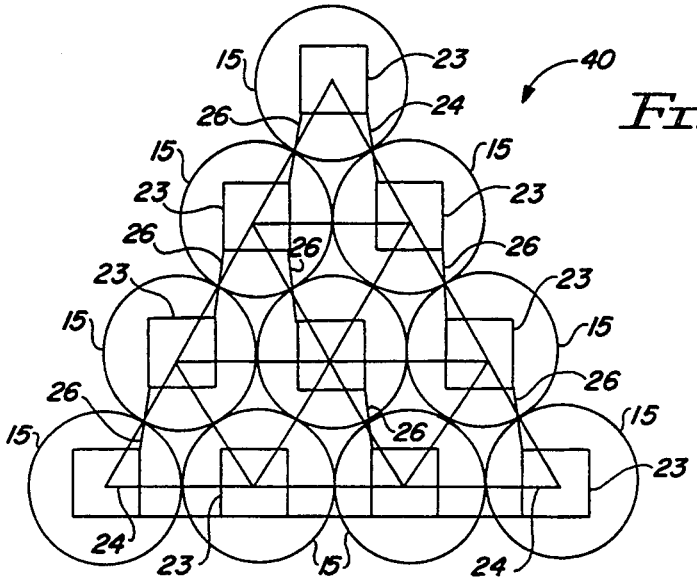
FIG. 13 is a top view of the bottom tier or layer of a plurality of spheres each embodying a housing module all interconnected by the triangulation of the greater equilateral octahedronal-tetrahedronal trusses.

For further stabilizing and additional load passing purposes, interconnecting rods 26 may be used to interlock together modules 23 in FIGS. 8 and 13 acting essentially as a membrane in absorbing and uniformly distributing loads to all of the framework of the modules.

Figure 9:
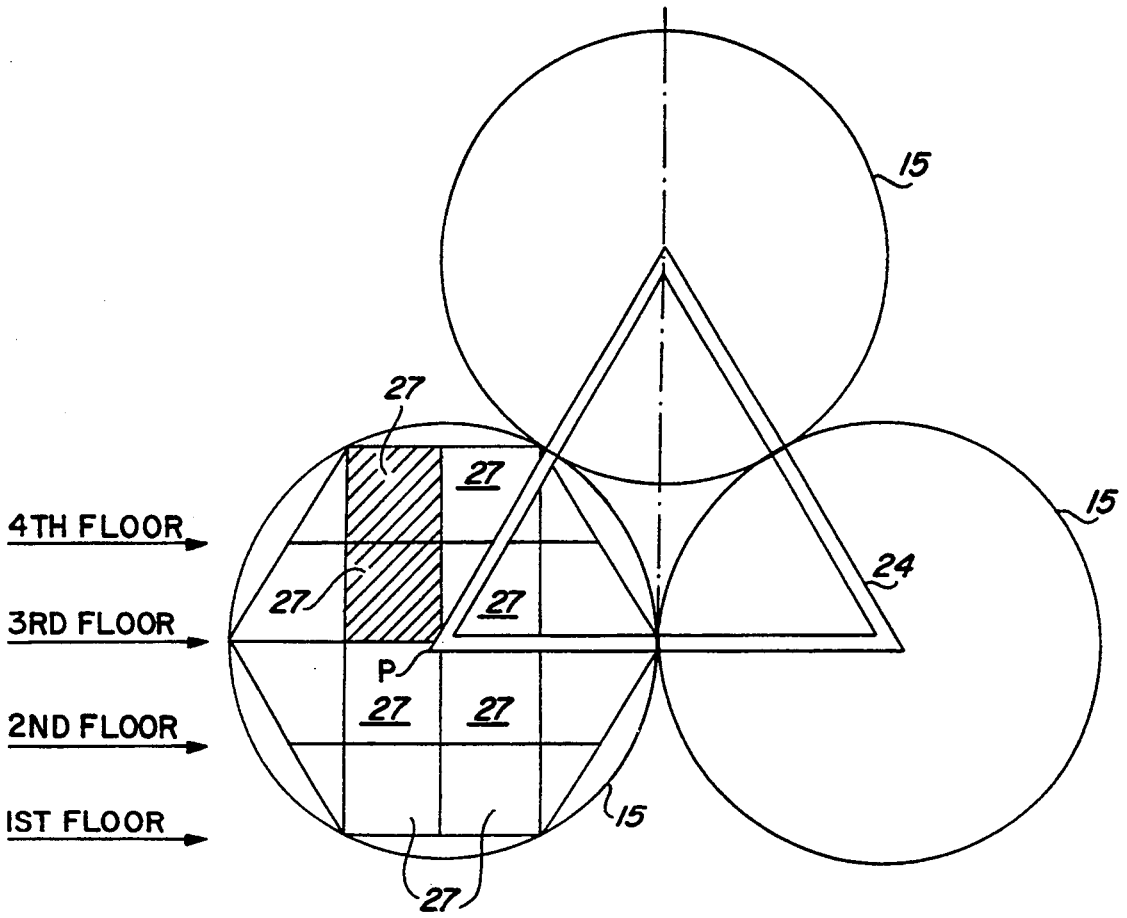
FIG. 9 is a side view of a two level stack of spheres illustrating a hi-level stack of eight modules within each sphere all held together by the greater and the many lesser octahedronal-tetrahedronal trusses.
Figure 10:
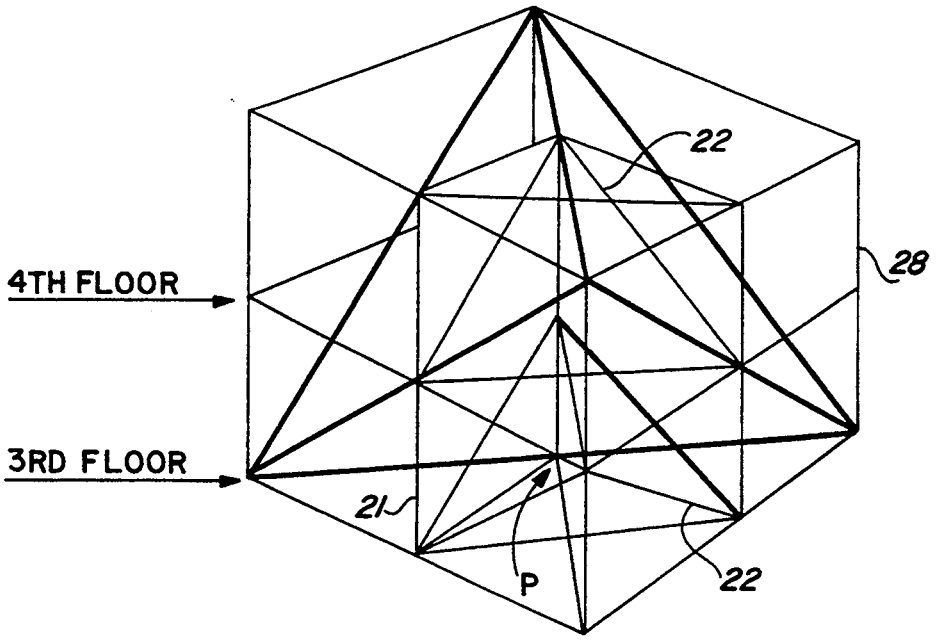
FIG. 10 is a perspective view of the four module illustration in FIG. 9 with each module further divided in two all held together by multiple sets of tetrahedrons becoming octahedronal-tetrahedronal upon interconnection with the many modules' cubic struts.

FIGS. 9 and 10 illustrate that each sphere 15 may be designed to contain multi-level modules 27 each being like the cubes 25 of FIG. 6 or modules 21 of FIG. 6.

FIG. 10 illustrate a cubical arrangement 28 of two levels that is divided into four modules 21 as shown in FIG. 6 for use in the physical array shown in FIG. 9.

Figure 11:
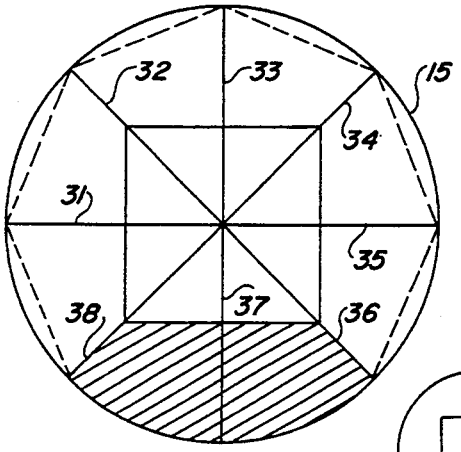
FIG. 11 is a top view of one of the spheres shown in FIG. 9 with hatched space for interconnecting hallways between spheres.
Figure 12:
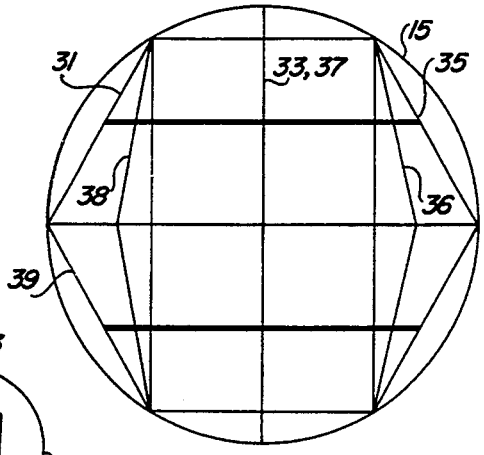
FIG. 12 is a side view of FIG. 11.

FIG. 11 illustrates a top view of one of the spheres 15 of FIG. 9 and FIG. 12 illustrates a side view of four levels thereof with like struts being given the same reference characters 31–38.

Figure 14:
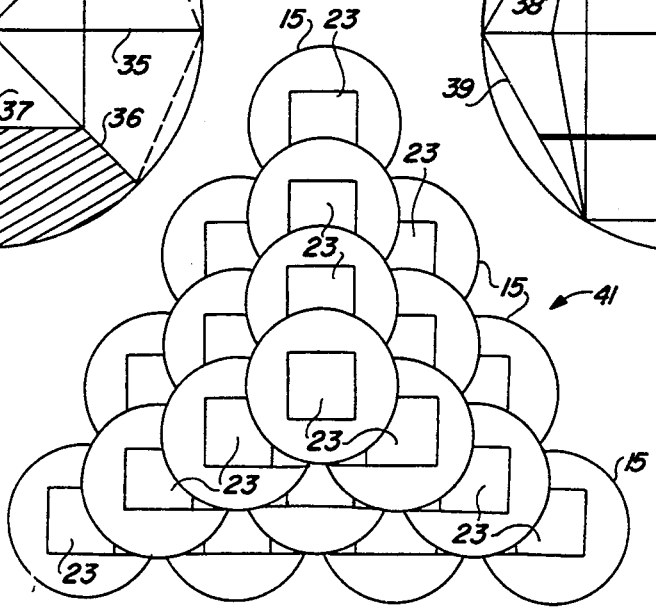
FIG. 14 is a top view of FIG. 13 but with the additions of three more tiers or layers of spheres to complete the stacking of the spheres.

FIG. 13 illustrates the top view of only the bottom tier base 40 of spheres 15 and FIG. 14 the top view of the completed four tiers of stacked spheres 15 in closest packing of spheres arrangement 41 to form a multi arrangement of cluster housing formed by modules 23 and 27 or any multiple of the modules. These modules with or without the enclosing spheres 15 are individually or collectively held together by the one greater equilateral octet truss and the many lesser part-isosceles-type octet trusses.

In accordance with the invention disclosed, a multi-level cluster housing arrangement is disclosed which is held together by a skeletal framework held together partially or totally by interlocking struts, sheets or a combination thereof.

An effective arrangement for multi-level cluster housing is thus provided in accordance with the stated objects of the invention and although but a few embodiments of the invention have been illustrated and described, it will be apparent to those skilled in the art that various changes and modifications may be made therein without departing from the spirit of the invention or from the scope of the appended claims.

What is claimed is:

1. A multi-level cluster housing array comprising:

a plurality of hollow spheres in a stacked array wherein each sphere is tangent to another, a plurality of identical struts having a predetermined length interconnected in a pattern consisting of a plurality of first octahedron-tetrahedron configurations, each of said first configurations being positionably in a different one of said spheres, the surface of said sphere being in contact with the corners of said configuration, said first struts of each of said first configurations defining between them an outline of a rectangular prism defining bi-level cubical housing, and each of prisms which its outline is enclosed by solid planes defining said bi-level cubical housing.

2. The multi-level cluster housing array set forth in claim 1 in further combination with:

a second plurality of identical struts interconnected in a pattern consisting of second octahedron-tetrahedron configurations, the struts of said second configurations interconnecting centers of spheres of different levels in said stacked array.

3. The multi-level cluster housing array set forth in claim 1 wherein:

said rectangular prism is divided by a multiple of two to form more than one juxtapositioned bi-level cubical housing.

4. The multi-level cluster housing array set forth in claim 1 in further combination with:

means for connecting each of said first configurations together with another one thereof and each of said second configurations with another one thereof.

5. The multi-level cluster housing array set forth in claim 1 wherein:

said spheres are stacked in a multi-level array.

a plurality of identical struts having a predetermined length interconnected in a pattern consisting of a plurality of first octahedron-tetrahedron configurations, each of said first configurations being positionably in a different one of said spheres, the surface of said sphere being in contact with the corners of said configuration,

6. A multi-level cluster housing array comprising:

a first plurality of identical struts interconnected in a pattern consisting of a plurality of first octahedron-tetrahedron configurations, said first struts of each of said first configurations defining between them an outline of a rectangular prism defining bi-level cubical housing, each of the prisms when its outline is enclosed by solid planes defining said bi-level cubical housing, a second plurality of identical struts having a predetermined length interconnected in a pattern consisting of a second octahedron-tetrahedron configurations, the struts of said second configurations interconnecting centers of said rectangular prisms in said stacked array, and a sphere having substantially the same diameter as the length of one of said second struts for surrounding said second configuration.

* * * * *

UNITED STATES PATENT AND TRADEMARK OFFICE

CERTIFICATE OF CORRECTION

PATENT NO. : 5,331,779

DATED : July 26, 1994

INVENTOR(S) : Ally O. Hing

It is certified that error appears in the above-indentified patent and that said Letters Patent is hereby corrected as shown below:

Column 6, claim 5, cancel lines 4 - 11.

Signed and Sealed this

Fourth Day of October, 1994

*Attest:*

Bruce Lehman

BRUCE LEHMAN

*Attesting Officer*

*Commissioner of Patents and Trademarks*